US008096358B2

(12) United States Patent
Rispler et al.

(10) Patent No.: US 8,096,358 B2
(45) Date of Patent: Jan. 17, 2012

(54) METHOD OF PERFORATING FOR EFFECTIVE SAND PLUG PLACEMENT IN HORIZONTAL WELLS

(75) Inventors: Keith A. Rispler, Red Deer (CA); Clarke G. Moir, Red Deer (CA); Jim B. Surjaatmadja, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 311 days.

(21) Appl. No.: 12/057,099

(22) Filed: Mar. 27, 2008

(65) Prior Publication Data

US 2009/0242202 A1 Oct. 1, 2009

(51) Int. Cl.
*E21B 33/13* (2006.01)
*E21B 33/12* (2006.01)
*E21B 43/26* (2006.01)

(52) U.S. Cl. ..... 166/292; 166/192; 166/177.5; 166/308.1

(58) Field of Classification Search ..... 166/281, 166/177.5, 280.1, 292, 293, 308.1, 192
See application file for complete search history.

(56) References Cited

U.S. PATENT DOCUMENTS 2,970,645 A * 2/1961 Glass ..... 166/281
5,547,023 A * 8/1996 McDaniel et al. ..... 166/280.1
5,765,642 A 6/1998 Surjaatmadja
6,070,666 A * 6/2000 Montgomery ..... 166/308.1
7,225,869 B2 6/2007 Willett et al. ..... 166/280.1
7,571,766 B2 * 8/2009 Pauls et al. ..... 166/280.1
7,690,427 B2 * 4/2010 Rispler ..... 166/293
7,735,556 B2 * 6/2010 Misselbrook et al. ..... 166/281
2005/0211439 A1 9/2005 Willett et al. ..... 166/308.1
2007/0284106 A1 12/2007 Kalman et al.

FOREIGN PATENT DOCUMENTS

WO WO2006/059056 A1 6/2006

OTHER PUBLICATIONS

Halliburton Brochure entitled "Multi-Zone Stimulation", 2006.
Romer et al., "Well-Stimulation Technology Progression in Horizontal Frontier Wells, Tip Top/Hogsback Field, Wyoming", SPE 110037, Nov. 2007.
International Search Report and Written Opinion for PCT/GB2009/000679 dated Dec. 1. 2010.
Norris et al., Multiple Proppant Fracturing of Horizontal Wellbores in a Chalk Formation: Evolving the Process in the Valhall Field; Society of Petroleum Engineers, 1998 SPE European Petroleum Conference held in The Hague, The Netherlands, Oct. 20-22, 1998, SPE 50608.

* cited by examiner

*Primary Examiner* — Angela M DiTrani
(74) *Attorney, Agent, or Firm* — Robert A. Kent; McDermott Will & Emery LLP

(57) ABSTRACT

Stimulation operations can be conducted by isolating portions of a subterranean formation adjacent to a highly deviated well bore. The planned settled height of a sand plug in a well bore adjacent a first zone of the subterranean formation is determined. The first zone is then perforated using a hydrajetting tool which is oriented so as to form perforations below the planned settled height of the sand plug.

20 Claims, 4 Drawing Sheets

METHOD OF PERFORATING FOR EFFECTIVE SAND PLUG PLACEMENT IN HORIZONTAL WELLS

BACKGROUND

The present invention relates to subterranean stimulation operations and, more particularly, to methods of isolating portions of a subterranean formation adjacent to a highly deviated well bore.

To produce hydrocarbons (e.g., oil, gas, etc.) from a subterranean formation, well bores may be drilled that penetrate hydrocarbon-containing portions of the subterranean formation. The portion of the subterranean formation from which hydrocarbons may be produced is commonly referred to as a "production zone." In some instances, a subterranean formation penetrated by the well bore may have multiple production zones at various locations along the well bore.

Generally, after a well bore has been drilled to a desired depth, completion operations are performed. Such completion operations may include inserting a liner or casing into the well bore and, at times, cementing a casing or liner into place. Once the well bore is completed as desired (lined, cased, open hole, or any other known completion) a stimulation operation may be performed to enhance hydrocarbon production into the well bore. Examples of some common stimulation operations involve hydraulic fracturing, acidizing, fracture acidizing, and hydrajetting. Stimulation operations are intended to increase the flow of hydrocarbons from the subterranean formation surrounding the well bore into the well bore itself so that the hydrocarbons may then be produced up to the wellhead.

There are almost always multiple zones along a well bore from which it is desirable to produce hydrocarbons. Stimulation operations, such as those mentioned above, may be problematic in subterranean formations comprising multiple production zones along the well bore. In particular, problems may result in stimulation operations where the well bore penetrates multiple zones due to the variation of fracture gradients between these zones. Different zones tend to have different fracture gradients. Moreover, in a situation wherein some zone along a wellbore is depleted, it will have a lower fracture gradient, than a less depleted or nondepleted zone. The more a zone is depleted, the lower the fracture gradient. Thus, when a stimulation operation is simultaneously conducted on more than one production zone, the stimulation treatment will tend to follow the path of least resistance and to preferentially enter the most depleted zones. Therefore, the stimulation operation may not achieve desirable results in those production zones having relatively higher fracture gradients. In some well bores, a mechanical isolation device such as a packer and bridge plugs may be used to isolate particular production zones, but such packers and plugs are often problematic due to the existence of open perforations in the well bore and the potential sticking of the devices. Additionally, in horizontal well bores the well bore is usually contained to one production area. It may be desirable to perform numerous stimulation treatments in a number of zones within the same production area along the length of the horizontal well bore.

One method used to combat problems encountered during the stimulation of a subterranean formation having multiple production zones involves placement of a sand plug into the well bore. When successfully placed, sand plugs isolate downstream zones along the well bore. Once a downstream zone has been isolated with a sand plug, other upstream production zones may be stimulated. Thus, sand plugs are placed so as to isolate zones farther from the wellhead (downstream) from zones closer to the wellhead (upstream). Conventional sand plug operations place sand into a well bore and allow it to settle into a portion of the well bore adjacent the zone to be isolated, so that fracturing fluids and other materials that are later placed into the well bore will not reach the isolated zone. That is, by filling a downstream portion of the well bore with a sand plug, the formation upstream of the sand plug may thereafter be stimulated without affecting the downstream, lower zone. Successively using such a technique allows for the formation of a plurality of stimulated zones along a horizontal well bore, each of which can be stimulated independently of the previously stimulated zones.

One known sand plug method is described in SPE 50608. More specifically, SPE 50608 describes the use of coiled tubing to deploy explosive perforating guns to perforate a treatment zone while maintaining well control and sand plug integrity. In the methods described in SPE 50608, a fracturing stage was performed through treatment perforations and then, once fracturing was complete, a sand plug was placed across the treatment perforations. The sand plug was placed by increasing the sand concentration in the treatment fluid while simultaneously reducing pumping rates, thus allowing a bridge to form. The paper describes how increased sand plug integrity could be obtained by performing a squeeze technique. As used herein the term "squeeze technique" refers to a technique wherein a portion of a treatment fluid comprising particulates is alternately pumped and stopped, thus exposing the treatment fluid to differential pressure against a zone of interest in stages over a period from several minutes to several hours. By alternately pumping and stopping, the treatment fluid is introduced to a zone at a pressure higher than necessary for fluid movement and thus the treatment fluid, and particulates therein are forced into the desired zone. One skilled in the art will recognize that a squeeze technique may be repeated as needed until a desired volume of particulates have been pumped, or until no further volume can be placed into the desired zone. The squeeze technique may be used to develop a sand plug that forms an effective hydraulic seal. However, when the well bore to be treated is a highly deviated well bore, traditional sand plugs, even with the implementation of a squeeze technique, are often ineffective at isolating zones along the highly deviated well bore. Often, in highly deviated well bores, a sand plug may fail to fully plug the diameter of the well bore.

As used herein, the term "highly deviated well bore" refers to a well bore that is oriented between 75-degrees and 90-degrees off-vertical (wherein 90-degrees off-vertical corresponds to fully a horizontal well bore). That is, the term "highly deviated well bore" may refer to a portion of a well bore that is anywhere from fully horizontal (90-degrees off-vertical) to 75-degrees off-vertical.

Other traditional methods of isolation are similarly difficult in highly deviated well bores. Mechanical packers, commonly used in cemented well bores, may be unsuitable for highly deviated well bores. Only a relatively small percentage of the highly deviated completions during the past 15 or more years used a cemented liner type completion; many highly deviated well bores are completed using some type of non-cemented liner or a bare open hole completion. Even those wells where a vertical, or not highly deviated, portion of the well bore was cemented tend not to be cemented in the highly deviated portions of the well bore.

SUMMARY

The present invention relates to subterranean stimulation operations and, more particularly, to methods of isolating portions of a subterranean formation adjacent to a highly deviated well bore.

In one embodiment, the present invention is directed to a method of completing a well in a subterranean formation, comprising the steps of: (a) determining a planned settled height of a sand plug; (b) perforating a first zone in the subterranean formation adjacent a first section of a well bore by injecting a pressurized fluid through a hydrajetting tool into the subterranean formation, so as to form one or more perforation tunnels, wherein the hydrajetting tool is oriented so as to form the one or more perforation tunnels below the planned settled height of the sand plug in the first section; (c) initiating one or more fractures in the first zone of the subterranean formation by injecting a fracturing fluid into the one or more perforation tunnels through the hydrajetting tool; (d) filling the first section with a sand plug up to the planned settled height; and (e) moving the hydrajetting tool to a second zone adjacent a second section of the well bore, wherein the second zone is upstream from the first zone.

In another embodiment, the present invention is directed to a method of completing a highly deviated well bore in a subterranean formation, comprising the steps of determining a first planned settled height of a sand plug in a highly deviated well bore; and, perforating a first zone in the subterranean formation by injecting a pressurized fluid through a hydrajetting tool into the subterranean formation, so as to form one or more perforations; wherein the hydrajetting tool is oriented, so as to form the one or more perforations below the first planned settled height of the sand plug in the highly deviated well bore.

The features and advantages of the present invention will be apparent to those skilled in the art from the description of the preferred embodiments which follows when taken in conjunction with the accompanying drawings. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION

Figure 1:
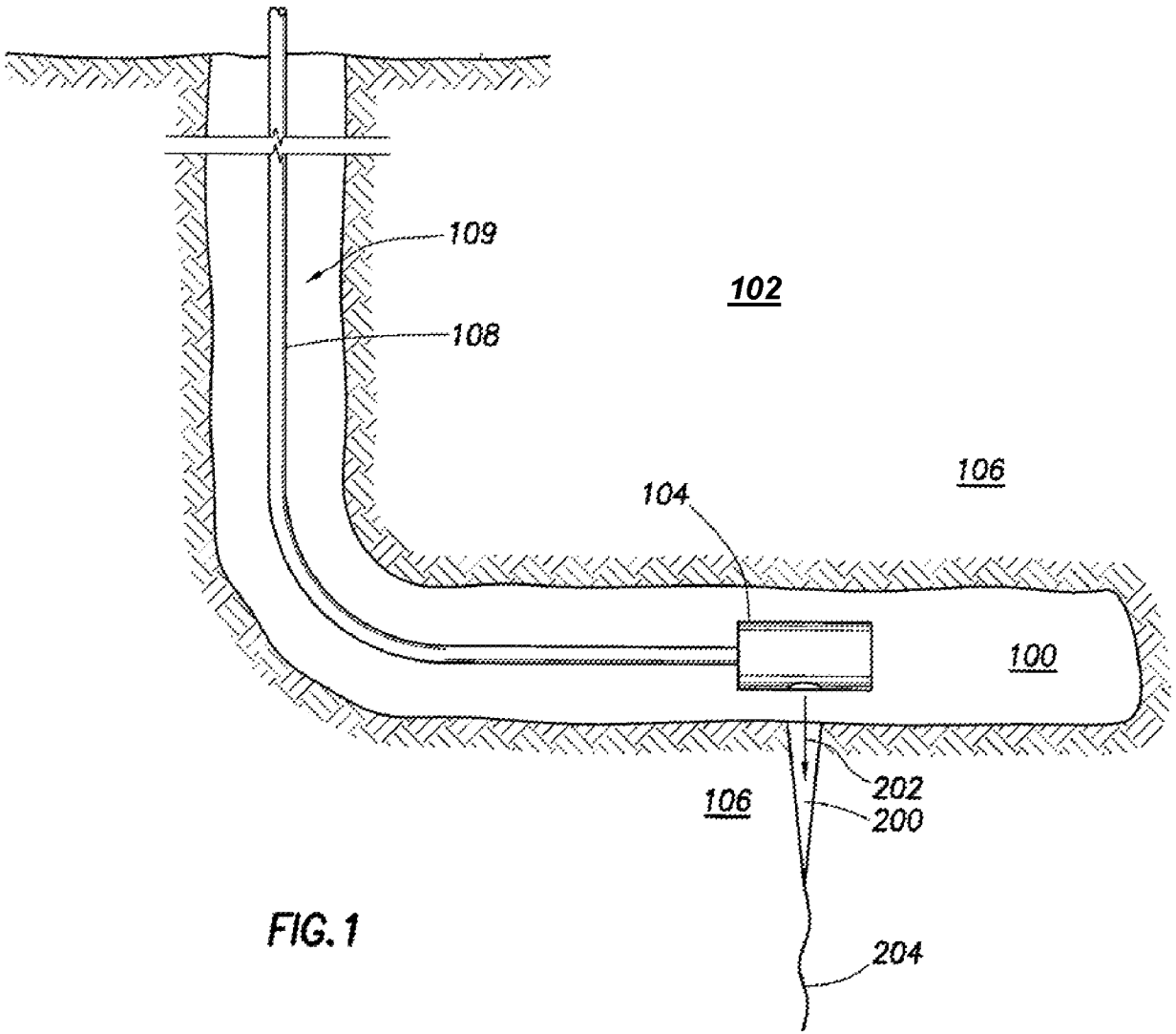
FIG. 1 illustrates an oriented perforating tool creating perforations at a first zone of the subterranean formation.

The present invention relates to subterranean stimulation operations and, more particularly, to methods of isolating portions of a subterranean formation adjacent to a highly deviated well bore. Among other things, the methods of the present invention allow for subterranean stimulation operations in highly deviated portions of a well bore wherein isolation of production zones farther from the wellhead from production zones closer to the wellhead is desired. The term "downstream" as used herein refers to the locations along a well bore relatively farther from the wellhead and the term "upstream" as used herein refers to locations along the well bore relatively closer to the wellhead.

The present invention may be used along well bores with any known completion style; including lined, cased and lined, open hole, cemented, or in any other fashion known in the art. Moreover, the present invention may be applied to portions along an older well bore or to newly drilled portions of a well bore.

Where methods of the present invention reference "stimulation," that term refers to any stimulation technique known in the art for increasing production of desirable fluids from a subterranean formation adjacent to a portion of a well bore. Such techniques include, but are not limited to, acid fracturing, hydraulic fracturing, perforating, and hydrajetting.

One suitable hydrajetting method, introduced by Halliburton Energy Services, Inc., is known as the SURGIFRAC and is described in U.S. Pat. No. 5,765,642. The SURGIFRAC process may be particularly well suited for use along highly deviated portions of a well bore, where casing the well bore may be difficult and/or expensive. The SURGIFRAC hydrajetting technique makes possible the generation of one or more independent, single plane hydraulic fractures. Furthermore, even when highly deviated or horizontal wells are cased, hydrajetting the perforations and fractures in such wells generally result in a more effective fracturing method than using traditional perforation and fracturing techniques. However, while techniques such as SURGIFRAC may lessen the need for zone isolation, it is nonetheless often desirable to use some method or tool to isolate a downstream zone from upstream zones either before performing SURGIFRAC or between SURGIFRAC stimulations.

Another suitable hydrajetting method, introduced by Halliburton Energy Services, Inc., is known as the COBRAMAX-H and is described in U.S. Pat. No. 7,225,869, which is incorporated herein by reference in its entirety. The COBRAMAX-H process may be particularly well suited for use along highly deviated portions of a well bore. The COBRAMAX-H technique makes possible the generation of one or more independent hydraulic fractures without the necessity of zone isolation, can be used to perforate and fracture in a single down hole trip, and may eliminate the need to set mechanical plugs through the use of a proppant slug. However, similar to the SURGIFRAC technique, while use of COBRAMAX-H may lessen the need for zone isolation, it is nonetheless often desirable to use some method or tool to isolate a downstream zone from upstream zones either before performing COBRAMAX-H or between COBRAMAX-H stimulations.

Some embodiments of the methods of the present invention are suitable for use on portions of highly deviated well bores having a downstream end and an upstream end wherein the portion of the well bore penetrates a plurality of zones within the subterranean formation and wherein successive isolation of zones is desirable. Generally, the methods of the present invention may be used to isolate upstream zones from downstream zones. The zones of the subterranean formation along the well bore may be thought of, for example, as a first zone located downstream (farthest from the wellhead), a second zone located upstream of the first zone, a third zone located upstream of the second zone, etc. For an instance wherein there are three zones to be stimulated, following the stimulation of the first zone (the most downstream zone) a sand plug may be placed according to the methods of the present invention so as to isolate the first zone from the second and third zones. Next, the second zone may be stimulated and then a sand plug may be placed according to the methods of the present invention so as to isolate the second zone from the third zone. While reference is made herein to first, second, and third zones, one skilled in the art will readily recognize that any number of zones may be implicated, and three zones are given only by way of example.

When placing a sand plug according to embodiments of the present invention, the carrier and particulates reach the first zone and enter into one or more stimulations therein. Over time, the stimulations, fill with particulates and once the stimulations are substantially filled, the particulates will begin to settle, and form a sand plug in the portion of the well bore surrounding that first zone. However, when this process is performed using traditional sand plugging methods in highly deviated portions of a well bore, the resulting sand plugs tend to slump and leave a gap in the well bore in a zone to be isolated. That is, in highly deviated portions of a well bore, the sand tends to settle to the bottom of the well bore such that the bottom of the well bore is isolated but the top of the well bore is not. As a result, some of the perforations will be left unplugged by the sand plug. Squeeze techniques may be employed to lift the sand off of the open face of the sand plug and to move it down the well bore along the plug to create a dune effect that fills the well bore from top to bottom. Generally, one skilled in the art will recognize that when enough iterations of the squeeze technique have been performed and the pump rate is increased to remobilize the particulates, the down hole pressure increases to a level close to or at the pressure expected to cause fracturing or other breakdown on the zone directly upstream of the zone being isolated.

To place a sand plug according to some embodiments of the methods of the present invention, particulates are suspended in a carrier fluid to be transported to the desired location along the well bore. Any fluid known in the art as suitable for transporting particulates (such as a gravel packing or fracturing fluid) may be used, including aqueous gels, emulsions, and other suitable viscous fluids. Suitable aqueous gels are generally comprised of water and one or more gelling agents. And suitable emulsions may be comprised of two or more immiscible liquids such as an aqueous gelled liquid and a liquefied, normally gaseous fluid, such as nitrogen. The preferred carrier fluids for use in accordance with this invention are aqueous gels comprised of water, a gelling agent for gelling the water and increasing its viscosity, and optionally, a cross-linking agent for cross-linking the gel and further increasing the viscosity of the fluid. The increased viscosity of the gelled or gelled and cross-linked carrier fluid, among other things, reduces fluid loss and allows the carrier fluid to transport significant quantities of suspended particulates. The carrier fluids may also include one or more of a variety of well-known additives such as breakers, stabilizers, fluid loss control additives, clay stabilizers, bactericides, and the like. The water used in the carrier fluid may be fresh water, salt water (e.g., water containing one or more salts dissolved therein), brine (e.g., saturated salt water), or seawater. Generally, the water can be from any source provided that it does not contain an excess of compounds that adversely affect other components in the resin composition or the performance of the resin composition relative to the subterranean conditions to which it may be subjected.

According to some embodiments of the present invention, the particulates suspended in the carrier fluid are placed into a well bore at a rate and pressure sufficient to deliver the particulates to the desired zone along the well bore. Once the particulates have been delivered to the desired location, they are allowed to settle for a period of time and form into a sand plug. In some embodiments, the particulates may be allowed to settle for as little as five minutes; preferably, the particulates are allowed to settle for at least ten minutes.

Figure 2:
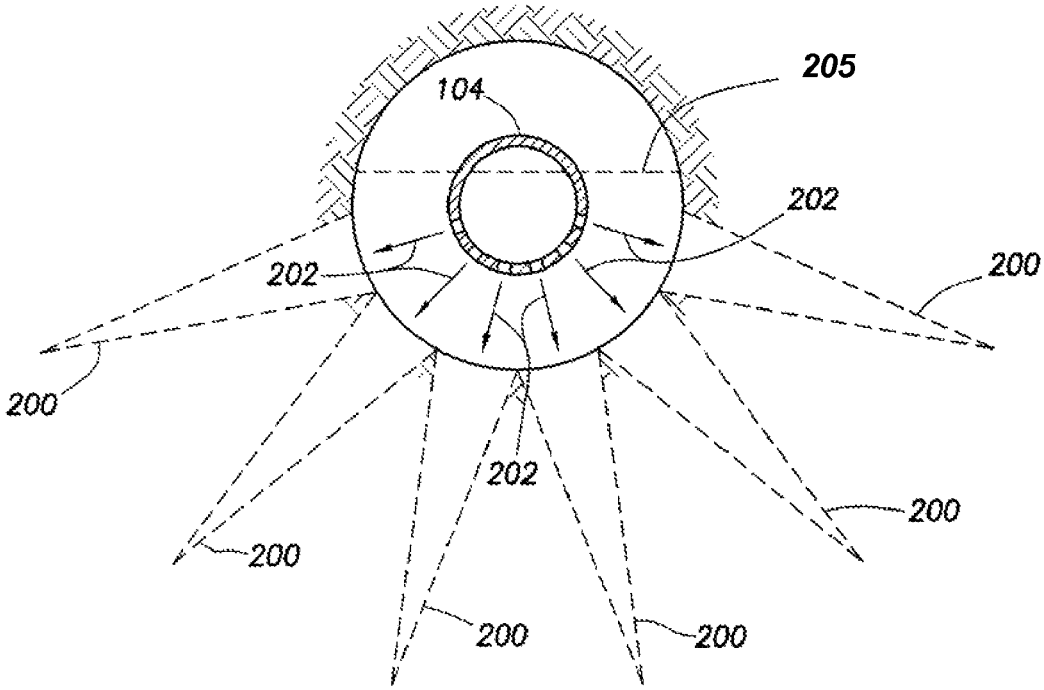
FIG. 2 illustrates a cross-sectional view of the highly deviated well bore of FIG. 1.
Figure 3:
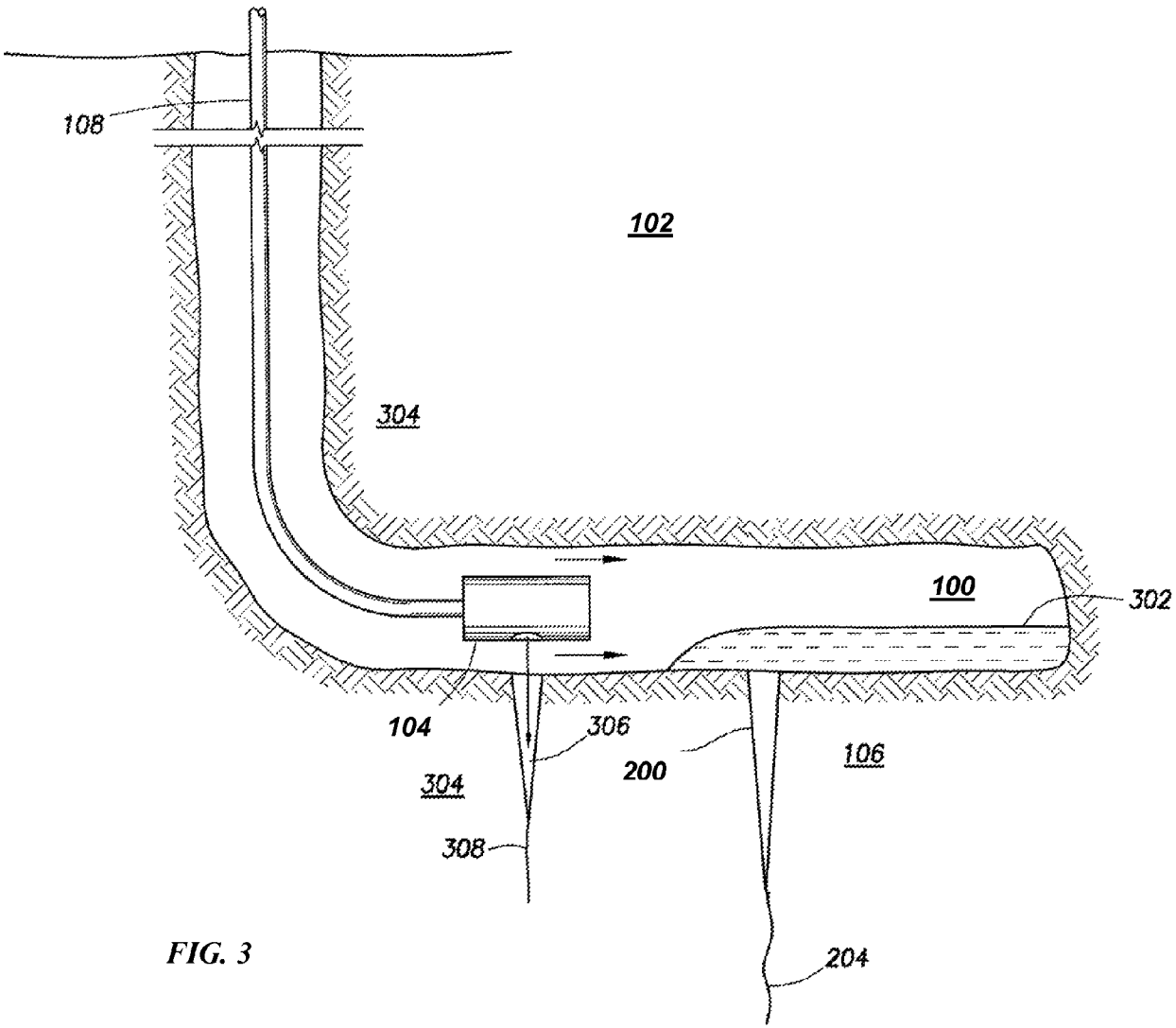
FIG. 3 illustrates an oriented perforating tool creating perforations at a second zone of the subterranean formation after the first zone has been plugged.

Referring now to the drawings wherein like reference numerals refer to the same or similar elements, FIG. 1 depicts a well bore 100 drilled into a subterranean formation of interest 102 using conventional (or future) drilling techniques. Next, depending on the nature of the formation, the well bore 100 is either left open hole, as shown in FIG. 1, or lined with a casing string or slotted liner (not shown). The well bore 100 may be left as an uncased open hole if, for example, the subterranean formation is highly consolidated or in the case where the well is a highly deviated or horizontal well, which are often difficult to line with casing. In cases where the well bore 100 is lined with a casing string, the casing string may or may not be cemented to the formation. Furthermore, when uncemented, the casing liner may be either a slotted or preperforated liner or a solid liner. Those of ordinary skill in the art will appreciate the circumstances when the well bore 100 should or should not be cased, whether such casing should or should not be cemented, and whether the casing string should be slotted, preperforated or solid. Indeed, the present invention does not lie in the performance of the steps of drilling the well bore 100 or whether or not to case the well bore, or if so, how. Furthermore, while FIGS. 1 through 3 illustrate the steps of the present invention being carried out in an uncased well bore, those of ordinary skill in the art will recognize that each of the illustrated and described steps can be carried out in a cased or lined well bore. The method can also be applied to an older well bore that has zones that are in need of stimulation.

Once the well bore 100 is drilled, and if deemed necessary cased, a hydrajetting tool 104, such as that used in the SURGIFRAC process or the COBRAMAX-H process, is placed into the well bore 100 at a location of interest, e.g. adjacent to a first zone 106 in the subterranean formation 102. In one exemplary embodiment, the hydrajetting tool 104 is attached to a coil tubing 108, which lowers the hydrajetting tool 104 into the well bore 100 and supplies it with jetting fluid. Annulus 109 is formed between the coil tubing 108 and the well bore 100. The hydrajetting tool 104 then operates to form perforation tunnels 200 in the first zone 106, as shown in FIG. 1. As shown in FIG. 1, the hydrajetting tool 104 of the present invention is an oriented perforating tool that will place the perforations 200 below the planned settled height of the sand plug, obviating the need for isolating the top portion of a well bore which may be beyond the settled height of the sand plug. Although only one perforation 200 is depicted in FIG. 1 going vertically downwards, as would be appreciated by those of ordinary skill in the art, with the benefit of this disclosure, the hydrajetting tool 104 may be oriented to create perforations in other directions. For instance, the hydrajetting tool 104 may create perforations 200 that would go into or come out of the paper in FIG. 1.

In the next step of the well completion method according to the present invention, the first zone 106 is fractured. This may be accomplished by any one of a number of ways. In one exemplary embodiment, the hydrajetting tool 104 injects a high pressure fracture fluid into the perforation tunnels 200. As those of ordinary skill in the art will appreciate, the pressure of the fracture fluid exiting the hydrajetting tool 104 is sufficient to fracture the formation in the first zone 106. Using this technique, the jetted fluid forms cracks or fractures 204 along the perforation tunnels 200. In a subsequent step, an acidizing fluid may be injected into the formation through the hydrajetting tool 104. The acidizing fluid etches the formation along the cracks 204 thereby widening them.

Once the first zone 106 has been fractured it is isolated, so that subsequent well operations, such as the fracturing of additional zones, can be carried out without the loss of significant amounts of fluid. In accordance with an embodiment of the present invention, a sand plug is placed in the section of the well bore adjacent the first zone 106 and is used to isolate the first zone 106.

Depicted in FIG. 2 is a cross-sectional view of the well bore 100 of FIG. 1. When a sand plug is placed in the well bore 100 it will not fill the entire vertical span of well bore 100. The height of the initial fill will vary based, in part, on the concentration of particulates in the carrier fluid used when placing the sand plug. For example, when a slurry of about 16 pounds per gallon particulates to carrier fluid is used, a fill height of about 60-70% might be expected and when a slurry of about 20 pounds per gallon particulates to carrier fluid is used, a fill height of about 70-80% might be expected. One skilled in the art, with the benefit of this disclosure and knowing the relative deviation of the well bore at issue, the pumping rates, and the concentration of particulates in the carrier fluid will be able to determine a suitable slurry concentration.

The planned settled height of the sand plug is depicted by a dotted line 205 in FIG. 2 and represents the height of the initial fill. As would be appreciated by those of ordinary skill in the art, with the benefit of this disclosure, the dotted line 205 is simply an example of the planned settled height of the sand plug and the planned settled height of the sand may be more or less than that depicted in FIG. 2. The perforation fluid being pumped through the hydrajetting tool 104 contains a base fluid, which is commonly water and abrasives (commonly sand). As shown in FIG. 2, jets (in this example) of fluid 202 are injected into the first zone 106 of the subterranean formation 102. As those of ordinary skill in the art will recognize, the hydrajetting tool 104 can have any number of jets, configured in a variety of combinations along and around the tool. In accordance with the methods of the present invention, the hydrajetting tool 104 is oriented and the jets 202 are configured so as to only create perforation 200 below the planned settled height of the sand plug 205. As would be appreciated by those of ordinary skill in the art, with the benefit of this disclosure, the perforations 200 may also be created sideways and angularly upwards (not shown).

In accordance with an embodiment of the present invention, the hydrajet tool 104 is oriented so as to only create perforations 200 that would fall below the planned settled height of the sand plug 205. As a result, an effective sand plug can be easily created without necessitating additional pumping operations to get the sand plug to cover and block perforations that were initially beyond the settled height of the sand plug. Although only one vertical perforation 200 is depicted in FIG. 1, as shown in FIG. 2, one or more perforations 200 in a number of different directions may be created below the planned settled height 205 of the sand plug.

Referring now to FIG. 3, after the sand plug 302 is formed in the first section of the well bore 100 adjacent the fractures 204, a second zone 304 in the subterranean formation 102 can be fractured. If the hydrajetting tool 104 has not already been moved within the well bore 100 to a second section adjacent to the second zone 304, as in the embodiment of FIG. 3, then it is moved there after the first zone 106 has been sealed by the sand plug 302. Once adjacent to the second zone 304, as in the embodiment of FIG. 3, the hydrajetting tool 104 is oriented again and operates to perforate the subterranean formation in the second zone 304 thereby forming perforation tunnels 306 below the planned settled height of the sand plug to be created there. Next, the subterranean formation 102 is fractured to form fractures 308 using the hydrajetting tool 104. The fractures 308 are then extended by continued fluid injection and using either proppant agents or acidizing fluids as noted above, or any other known technique for holding the fractures 308 open and conductive to fluid flow at a later time. The fractures 308 can then be sealed by a sand plug 302 using the same techniques discussed above with respect to the fractures 204. The method can be repeated where it is desired to fracture additional zones within the subterranean formation 102. As would be appreciated by those of ordinary skill in the art, with the benefit of this disclosure, the planned settled height of the sand plug in the first zone and the second zone may be the same or may be different.

Once all of the desired zones have been fractured, the sand plugs can be recovered thereby unplugging the fractures 204 and 308 for subsequent use in the recovery of hydrocarbons from the subterranean formation 102.

As used herein, the term "lightweight particulates" refers to particulates having a specific gravity of at or below about 1.25. Suitable lightweight particulates include, but are not limited to, polymer materials; TEFLON® (polytetrafluoroethylene materials); nut shell pieces; seed shell pieces; cured resinous particulates comprising nut shell pieces; cured resinous particulates comprising seed shell pieces; fruit pit pieces; cured resinous particulates comprising fruit pit pieces; wood; composite particulates and combinations thereof. Composite particulates may also be suitable for use as lightweight particulates in the present invention so long as they exhibit a specific gravity of below about 1.25. In some embodiments, the lightweight particulates may be degradable materials, such as those used as degradable fluid loss materials. In some preferred embodiments, suitable lightweight particulates exhibit a specific gravity of below about 1.20. In other preferred embodiments, suitable lightweight particulates exhibit a specific gravity of below about 1.10.

One suitable commercially available lightweight particulate is a product known as BIOVERT® manufactured by Halliburton Energy Services headquartered in Duncan, Okla. BIOVERT® is a polymer material comprising 90-100% polylactide and having a specific gravity of about 1.25.

Lightweight degradable materials that may be used in conjunction with the present invention include, but are not limited to, degradable polymers, dehydrated compounds, and mixtures thereof. Such degradable materials are capable of undergoing an irreversible degradation downhole. The term "irreversible" as used herein means that the degradable material, once degraded downhole, should not recrystallize or reconsolidate, e.g., the degradable material should degrade in situ but should not recrystallize or reconsolidate in situ.

Suitable examples of degradable polymers that may be used in accordance with the present invention include, but are not limited to, homopolymers, random, block, graft, and star- and hyper-branched polymers. Specific examples of suitable polymers include polysaccharides such as dextran or cellulose; chitin; chitosan; proteins; aliphatic polyesters; poly(lactide); poly(glycolide); poly(ϵ-caprolactone); poly(hydroxybutyrate); poly(anhydrides); aliphatic polycarbonates; poly (ortho esters); poly(amino acids); poly(ethylene oxide); and polyphosphazenes. Polyanhydrides are another type of particularly suitable degradable polymer useful in the present invention. Examples of suitable polyanhydrides include poly (adipic anhydride), poly(suberic anhydride), poly(sebacic anhydride), and poly(dodecanedioic anhydride). Other suitable examples include but are not limited to poly(maleic anhydride) and poly(benzoic anhydride). One skilled in the art will recognize that plasticizers may be included in forming suitable polymeric degradable materials of the present invention. The plasticizers may be present in an amount sufficient to provide the desired characteristics, for example, more effective compatibilization of the melt blend components, improved processing characteristics during the blending and processing steps, and control and regulation of the sensitivity and degradation of the polymer by moisture.

Suitable dehydrated compounds are those materials that will degrade over time when rehydrated. For example, a particulate solid dehydrated salt or a particulate solid anhydrous borate material that degrades over time may be suitable. Specific examples of particulate solid anhydrous borate materials that may be used include but are not limited to anhydrous sodium tetraborate (also known as anhydrous borax), and anhydrous boric acid. These anhydrous borate materials are only slightly soluble in water. However, with time and heat in a subterranean environment, the anhydrous borate materials react with the surrounding aqueous fluid and are hydrated. The resulting hydrated borate materials are substantially soluble in water as compared to anhydrous borate materials and as a result degrade in the aqueous fluid.

Blends of certain degradable materials and other compounds may also be suitable. One example of a suitable blend of materials is a mixture of poly(lactic acid) and sodium borate where the mixing of an acid and base could result in a neutral solution where this is desirable. Another example would include a blend of poly(lactic acid) and boric oxide. In choosing the appropriate degradable material or materials, one should consider the degradation products that will result. The degradation products should not adversely affect subterranean operations or components. The choice of degradable material also can depend, at least in part, on the conditions of the well, e.g., well bore temperature. For instance, lactides have been found to be suitable for lower temperature wells, including those within the range of 60° F. to 150° F., and polylactide have been found to be suitable for well bore temperatures above this range. Poly(lactic acid) and dehydrated salts may be suitable for higher temperature wells. Also, in some embodiments a preferable result is achieved if the degradable material degrades slowly over time as opposed to instantaneously. In some embodiments, it may be desirable when the degradable material does not substantially degrade until after the degradable material has been substantially placed in a desired location within a subterranean formation.

Figure 4A:
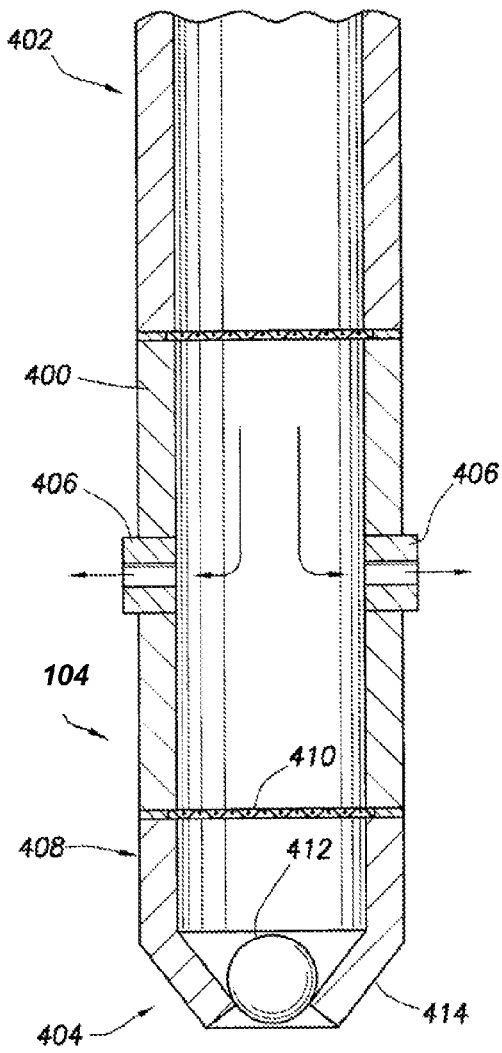
FIGS. 4A and 4B illustrate operation of a hydrajetting tool for use in carrying out the methods according to the present invention.
Figure 4B:
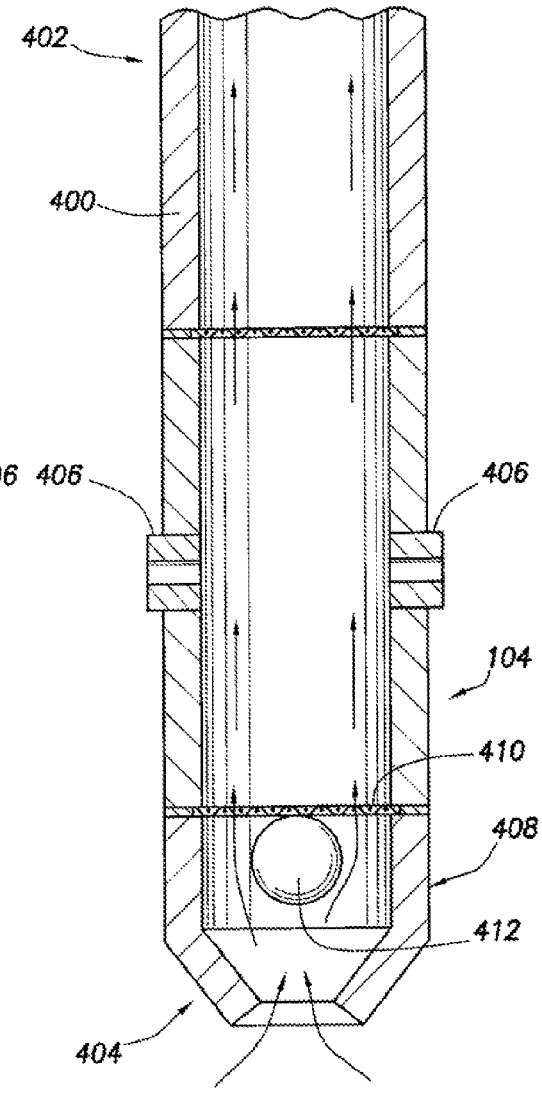

FIGS. 4A-B illustrate the details of the hydrajetting tool 104 for use in carrying out the methods of the present invention. Hydrajetting tool 104 comprises a main body 400, which is cylindrical in shape and formed of a ferrous metal. The main body 400 has a top end 402 and a bottom end 404. The top end 402 connects to coil tubing 108 for operation within the well bore 100. The main body 400 has a plurality of nozzles 406, which are adapted to direct the high pressure fluid out of the main body 400. The nozzles 406 can be disposed, and in one certain embodiment are disposed, at an angle to the main body 400, so as to eject the pressurized fluid out of the main body 400 at an angle other than 90°. As discussed above, the hydrajetting tool 104 may be oriented in a direction so as to create perforations that would lie below a planned settled height of the sand which is used to isolate a particular zone.

The hydrajetting tool 104 further comprises means 408 for opening the hydrajetting tool 104 to fluid flow from the well bore 100. Such fluid opening means 408 includes a fluid-permeable plate 410, which is mounted to the inside surface of the main body 400. The fluid-permeable plate 410 traps a ball 412, which sits in seat 414 when the pressurized fluid is being ejected from the nozzles 406, as shown in FIG. 4A. When the pressurized fluid is not being pumped down the coil tubing into the hydrajetting tool 104, the well bore fluid is able to be circulated up to the surface via opening means 408. More specifically, the well bore fluid lifts the ball 412 up against fluid-permeable plate 410, which in turn allows the fluid to flow up the hydrajetting tool 104 and ultimately up through the coil tubing 108 to the surface, as shown in FIG. 4B. As those of ordinary skill in the art will recognize other valves can be used in place of the ball and seat arrangement 412 and 414 shown in FIGS. 4A and 4B. Darts, poppets, and even flappers, such as a balcomp valves, can be used. Furthermore, although FIGS. 4A and 4B only show a valve at the bottom of the hydrajetting tool 104, such valves can be placed both at the top and the bottom, as desired.

Therefore, the present invention is well-adapted to carry out the objects and attain the ends and advantages mentioned as well as those which are inherent therein. While the invention has been depicted and described by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects. The terms in the claims have their plain, ordinary meaning unless otherwise explicitly and clearly defined by the patentee.

What is claimed is:

1. A method of completing a highly deviated well bore oriented between 75 degrees and 90 degrees off vertical in a subterranean formation, the method comprising the steps of:

(a) determining a planned settled height of a sand plug that does not fill an entire vertical span of the well bore;

(b) perforating a first zone in the subterranean formation adjacent a first section of the well bore by injecting a pressurized fluid through a hydrajetting tool into the subterranean formation, so as to form one or more perforation tunnels only below the planned settled height of the sand plug, wherein the hydrajetting tool is oriented so as to form the one or more perforation tunnels only below the planned settled height of the sand plug in the first section;

(c) initiating one or more fractures in the first zone of the subterranean formation by injecting a fracturing fluid into the one or more perforation tunnels through the hydrajetting tool;

(d) filling the first section with a sand plug up to the planned settled height that does not fill an entire vertical span of the well bore; and (e) moving the hydrajetting tool to a second section adjacent a second zone of the well bore, wherein the second zone is upstream from the first zone.

2. The method of claim 1, further comprising the step of repeating steps (a) through (e) in the second zone of the subterranean formation.

3. The method of claim 1, wherein the sand plug comprises particulates.

4. The method of claim 3, wherein the particulates are selected from the group consisting of: traditional particulates and lightweight particulates.

5. The method of claim 4, wherein the lightweight particulates are selected from the group consisting of: polymer materials; polytetrafluoroethylene materials; seed shell pieces; cured resinous particulates comprising nut shell pieces; cured resinous particulates comprising seed shell pieces; fruit pit pieces; cured resinous particulates comprising fruit pit pieces; wood; composite particulates; and a polymer material comprising 90-100% polylactide and having a specific gravity of about 1.25.

6. The method of claim 4, wherein the traditional particulates are selected from the group consisting of: sand, ceramic beads, bauxite, glass microspheres, synthetic organic beads, and sintered materials.

7. The method of claim 3, further comprising suspending the particulates in a carrier fluid to be transported to the first zone.

8. The method of claim 7, wherein the carrier fluid is selected from the group consisting of: an aqueous gel and an emulsion.

9. The method of claim 1, wherein the pressurized fluid comprises a base fluid and abrasives.

10. A method of completing a highly deviated well bore oriented between 75 degrees and 90 degrees off vertical in a subterranean formation, the method comprising the steps of:

determining a first planned settled height of a sand plug in the highly deviated well bore that does not fill an entire vertical span of the well bore; and perforating a first zone in the subterranean formation by injecting a pressurized fluid through a hydrajetting tool into the subterranean formation, so as to form one or more perforations only below the first planned settled height of the sand plug;

wherein the hydrajetting tool is oriented so as to form the one or more perforations only below the first planned settled height of the sand plug in the highly deviated well bore.

11. The method of claim 10, further comprising:

moving the hydrajetting tool to a second zone in the subterranean formation, wherein the first zone is closer to a downstream end of the highly deviated well bore than is the second zone;

determining a second planned settled height of a sand plug in the highly deviated well bore that does not fill an entire vertical span of the well bore; and perforating the second zone in the subterranean formation by injecting a pressurized fluid through the hydrajetting tool into the subterranean formation, so as to form one or more perforations only below the second planned settled height;

wherein the hydrajetting tool is oriented so as to form the one or more perforations only below the second planned settled height of the sand plug in the highly deviated well bore.

12. The method of claim 10, further comprising the step of:

filling the first zone with a sand plug up to the first planned settled height of the sand plug that does not fill an entire vertical span of the well bore.

13. The method of claim 12, wherein the sand plug comprises particulates.

14. The method of claim 13, wherein the particulates are selected from the group consisting of: traditional particulates and lightweight particulates.

15. The method of claim 14, wherein the lightweight particulates are selected from the group consisting of: polymer materials; polytetrafluoroethylene materials; seed shell pieces; cured resinous particulates comprising nut shell pieces; cured resinous particulates comprising seed shell pieces; fruit pit pieces; cured resinous particulates comprising fruit pit pieces; wood; composite particulates; and a polymer material comprising 90-100% polylactide and having a specific gravity of about 1.25.

16. The method of claim 14, wherein the traditional particulates are selected from the group consisting of: sand, ceramic beads, bauxite, glass microspheres, synthetic organic beads, and sintered materials.

17. The method of claim 13, further comprising suspending the particulates in a carrier fluid to be transported to the first zone.

18. The method of claim 17, wherein the carrier fluid is selected from the group consisting of: an aqueous gel and an emulsion.

19. The method of claim 10, wherein the pressurized fluid comprises a base fluid and abrasives.

20. The method of claim 19, wherein the base fluid is water.

* * * * *